United States Patent [19]

Gibson

[11] 4,103,522

[45] Aug. 1, 1978

[54] SPIRAL DASHER FOR WASHING MACHINES

[76] Inventor: George M. Gibson, 640 W. 249th St., Riverdale, N.Y. 10471

[21] Appl. No.: 781,501

[22] Filed: Mar. 25, 1977

[51] Int. Cl.[2] ..... D06F 17/10

[52] U.S. Cl. ..... 68/133; 68/134

[58] Field of Search ..... 68/131, 133, 134, 175, 68/184, 54, 89, 90, 92; 259/107, 108

[56] References Cited

U.S. PATENT DOCUMENTS

| | | | |
|---|---|---|---|
| 1,734,632 | 11/1929 | Merrill | 68/131 X |
| 2,630,696 | 3/1953 | Castner | 68/131 |
| 3,025,690 | 3/1962 | Lathuy | 68/134 |
| 3,233,436 | 2/1966 | Gibson | 68/133 |
| 3,294,373 | 12/1966 | Cochran | 259/107 |

FOREIGN PATENT DOCUMENTS

| | | | |
|---|---|---|---|
| 189,584 | 5/1964 | Sweden | 259/107 |

*Primary Examiner*—Philip R. Coe

*Attorney, Agent, or Firm*—Glenn H. Antrim

[57] ABSTRACT

A spiral outwardly facing surface, driving surface, of a dasher forces wash almost radially outwardly with little tendency for the wash to be whirled with the dasher. Therefore, the dasher can be driven unidirectionally by apparatus that is much simpler and more economical than the gearing used for reciprocating motion in conventional washing machines. Preferably, the height of the spiral surface is low, the change in rate of curvature is gradual, and a line normal to the tangent of the outer portion of the spiral is nearly radial to propel clothes radially while the dasher is being rotated at a speed within the range of speed normally used for drying by spinning. The use of the spinning rate further simplifies the rotative driving apparatus.

2 Claims, 5 Drawing Figures

SPIRAL DASHER FOR WASHING MACHINES

BACKGROUND OF THE INVENTION

This invention relates to washing machines having impellers to be rotated unidirectionally, and particularly to washing machines with dashers having spiral surfaces to be rotated at relatively high speeds for circulating clothes radially therefrom.

Early manual washing machines and most of the subsequent electric washing machines have used reciprocating agitators for moving clothes back and forth in water to clean them. Some of the early agitators, or dollies, had one or more downwardly extending pegs that contacted the clothes and moved them in a reciprocating motion within the water and against the corrugated inside surfaces of the tubs of the washers. The clothes were generally merely being rotated reciprocally as a single body attached to a crank. The type of agitators that have become most widely accepted for electric washing machines have three or four long vertical vanes, and by reciprocating the agitators, the vanes tend to circulate articles of clothing to wash them uniformly. However, when the washing machines are moderately or heavily loaded, the articles bunch and, as in the washers using the old dollies, follow the agitator as if attached to a crank. When the clothes are bunched, they are not washed uniformly and are worn unnecessarily.

The reciprocating rotation of the agitators, rather than unidirectional rotation, is considered to be necessary to cause the required rubbing of the clothes for cleaning and to prevent the clothes from bunching and whirling with the agitators. The apparent necessity for having reciprocation of the agitators requires quite complicated arrangements of gears between the driving motors and the agitators. The gear arrangements are expensive and are subject to wear because of the usual shocks accompanying reciprocating motion.

While the present washing machines that use reciprocating agitators were being developed and improved, development work also progressed on washing machines using unidirectionally driven impellers. One of the later washing machines of this type is shown in U.S. Pat. No. 3,233,436, issued to the present inventor on Feb. 8, 1966. The impellers used in the washing machines described in that patent have relatively low profiles, and the bottoms of the tubs had cavities about the impellers. Water was first driven from the impellers into the cavities to be redirected into columns to prevent the water and wash from being whirled excessively by the impellers. As with other washing machines having unidirectionally driven impellers, the impellers and the tubs were designed especially to decrease the tendency for wash to be collected together and to be whirled with the impellers. Although some of the better washing machines using unidirectionally driven impellers would do fairly well in preventing entanglement and in circulating the clothes to clean them uniformly, none of them apparently reached high enough standards in these respects to be widely accepted in spite of their economical and long-lasting driving apparatus.

The impellers in the patent to which reference has been made above have pockets between ridges for slinging water radially outwardly into cavities that surround the impellers. The ends of the ridges between the pockets are curved in a direction opposite to the direction of the rotation of the impellers merely to prevent the impellers from grabbing articles of clothing in the wash. The arcuate surfaces of the ridges do not have a gradual changing rate of curvature to provide gentle but forcible radial movement of clothes when rotated at relatively high speeds.

SUMMARY OF THE INVENTION

An object of the present invention is to provide a thoroughly effective washing action by having a unidirectional dasher create cycling, toroidal currents of water having a throbbing action moving outwardly and upwardly and by having the dasher forcefully thrust the clothes outwardly. The dashers of washing machines according to the present invention are characterized by spirals about the respective axes of rotation. To thrust wash outwardly, the spirals have driving surfaces facing outwardly with respect to the axes, and preferably the curvature and the rate of curvature of the spirals are very gradual. The height of the driving surfaces is only moderate, for the dashers are to be rotated at a speed greater than normal during the washing cycle, for example, a speed within the range of speeds normally used for drying by spinning. A dasher is rotated only in one direction to cause its spiral driving surface to travel radially outwardly over its respective length and thereby to function as a gradually inclined plane of a screw to propel the wash water and to thrust the adjacent clothes outwardly. The curvature of the spirals is very gradual to prevent unnecessary wear on clothing by sudden thrusts when they become in contact with the dashers, but the rate of rotation of the dashers is sufficient to move the clothes forcefully outwardly to provide effective cleaning. A line normal to the tangent of the outer portion of a spiral surface is almost radial, and as the surface functions as an inclined plane of a screw, the wash and liquid are forced almost radially outwardly.

The dashers not only function as gradual inclined planes to move radially the clothes that circulate close to the dashers, but because of their rate of rotation create about the respective dashers strong pulsations for cleaning. As the clothes are driven outwardly from the dashers, the articles of clothing are unfurled and separated to provide uniform cleaning, are flexed and rubbed to be cleaned effectively, and are moved almost radially outwardly, normal to tangent of the driving surfaces. After being moved outwardly, the clothes in a washing machine are circulated along the walls of its tub in an axial direction away from the dasher and then over to a central column where the clothes are being moved in the opposite direction toward the dasher. Compared with prior agitators that are rotated unidirectionally, the directions of the forces applied to the wash by the present dashers are so nearly radial that the tendency for the clothes to be whirled is nearly absent. As the result, the requirement for special baffles and special cavities, or other surfaces to prevent whirling, is nearly eliminated. When washing machines using the dashers of the present invention are moderately or heavily loaded with wash, the inertia of the wash alone is sufficient to prevent detrimental whirling. When the washing machines have no load or are only lightly loaded, the surface tension of the liquid on the surfaces of the rapidly rotating dashers is sufficient to create a suction or whirl in spacious, smooth tubs where the dashers are centrally located. To prevent this undesirable whirling, some deflecting means may be provided, or the tubs can be merely shaped irregularly with respect to the dashers to prevent whirling.

Compared with the driving apparatus for reciprocating conventional gyrators, the driving apparatus for rotating the present dashers unidirectionally are greatly simplified, and therefore, are manufactured much more economically. Through the use of driving surfaces having gradual curvatures and having relatively low profiles, the present dashers can be driven at the rate ordinarily used for drying by spinning, and therefore the driving apparatus can be further simplified to provide only one rate of rotation.

DESCRIPTION OF THE PREFERRED EMBODIMENTS

Figure 1:
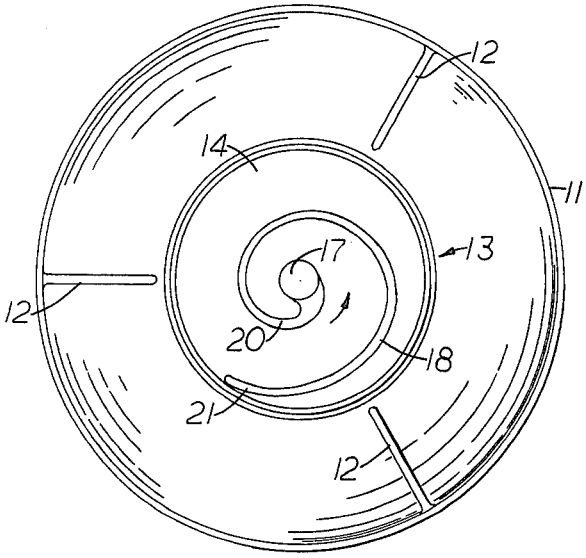
FIG. 1 is a top view of a round tub of a washing machine using a volute dasher of this invention centered in the bottom thereof.
Figure 2:
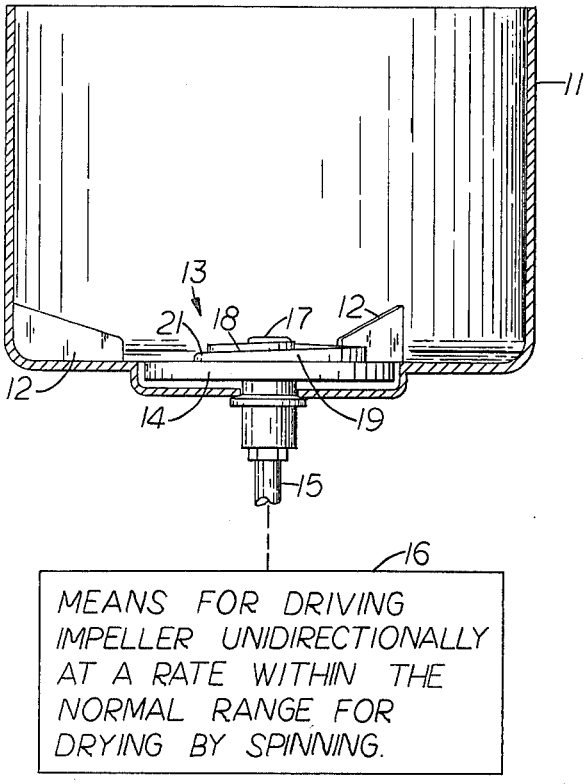
FIG. 2 is a vertical cross-sectional view of the round tub of FIG. 1.

In FIGS. 1 and 2, a volute dasher 13 according to the present invention is shown mounted in the center of the bottom of a round tub 11 that is conventional except for three small baffles 12. Compared with prior washing machines that used unidirectionally driven gyrators, only a few baffles of relatively small size are required, and they are not required for normal loads of wash. Each of the baffles 12 is only about as high as the dasher 13 and extends radially from the wall of the tub 11 inwardly such that the inner end, which may be tapered downwardly, is spaced from the periphery of the dasher 13.

The dasher 13 has a disk-shaped base 14 and an upper volute portion comprising a spiral vane 18. The diameter of the base 14 may be about one-half the diameter of the tub 11, and the base 14 has a conventional hub 17 for connecting the dasher 13 coaxially to a drive shaft 15. To rotate the dasher 13 unidirectionally, the drive shaft 15 is connected to a driving means 16 that preferably has a rate of speed within the normal range of speeds for drying by spinning.

The volute portion of the dasher 13 comprises a spiral vane 18 that has an outer or driving surface 19 that is parallel in its lateral direction to the axis of the dasher 13. The inner end 20 of the spiral vane 18 starts at the hub 17, and the remainder of the spiral vane extends spirally with decreasing rate of curvature for slightly more than one turn to the outer end 21 of the spiral van 18 adjacent the outer edge of the circular base 14. As shown in the drawing, the inner ends of the spiral vane 18 and the driving surface 31 terminate in smooth, gradual contours at hubs 17 and 30, respectively, and the outer ends 21 and 34 terminate gradually and smoothly at the outer edges of their respective bases. The height and the length of the spiral vane 18 is dependent on the speed at which the dasher 13 is to be rotated. As an example, a tube 11 may be 21 inches (53 cm) in diameter, the dasher 13 may be 9 inches (22.9 cm) in diameter, and the spiral vane 18 may be approximately one turn in length and less than 1 inch (2.5 cm) high.

Figure 3:
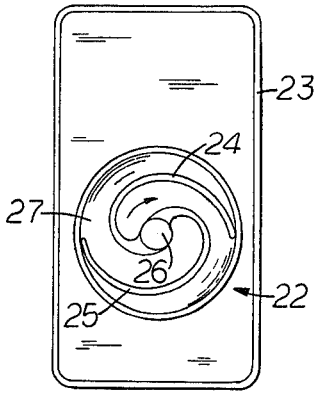
FIG. 3 is a top view of a rectangular tub using a different volute dasher of this invention.

According to FIG. 3, a dasher 22 is positioned somewhat toward one end in the bottom of a rectangular tub 23. The dasher 22 may have a single spiral vane as shown for the dasher 13 of FIG. 1, or may, as shown in FIG. 3, have a pair of spiral vanes 24 and 25 that are each somewhat more than one-half turn in length and that have relative locations 180° apart where they start from the hub 26 and extend over the plane surface of a base 27. By placing the dasher 22 at a distance from the center of the rectangular tub 23, baffles are not required to prevent the small tendency for water alone or a small load of wash in water to be whirled.

Figure 4:
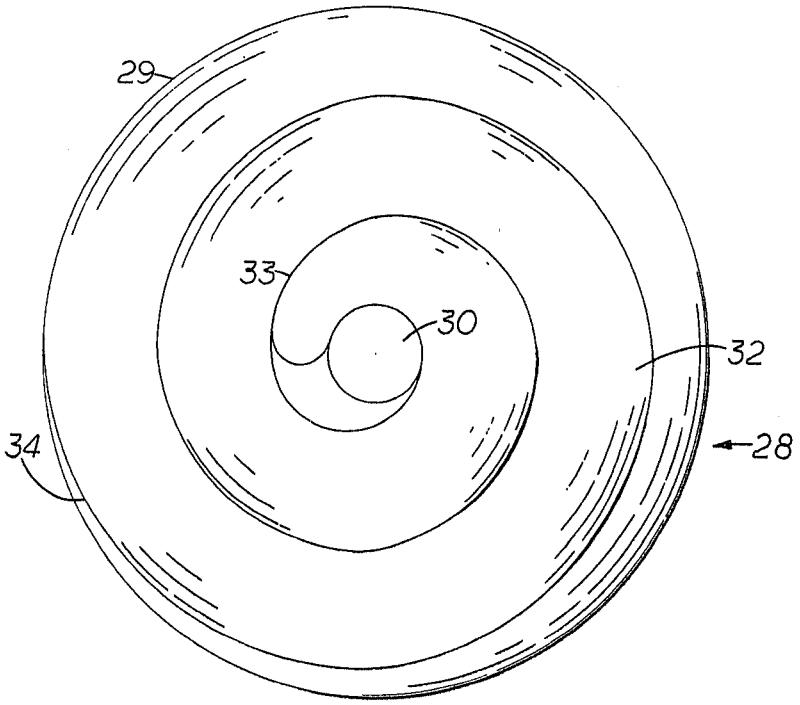
FIG. 4 is a top view of a different dasher having a single driving spiral on a conical base.
Figure 5:
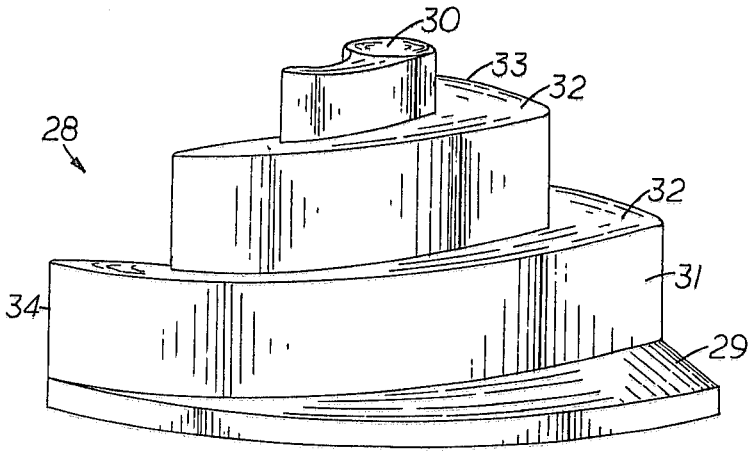
FIG. 5 is an oblique side view of the dasher of FIG. 4.

In manufacturing, dashers according to the embodiment shown in FIGS. 4 and 5 are preferred because they can be fabricated to provide ample strength, and they have hubs of sufficient length to facilitate connection to center posts and drive shafts. A dasher 28 has a conical base 29, and the base has a coaxial hub 30 to be supported by a post and connected to a drive shaft. An outwardly facing driving surface 31 has an end 33 about the hub 30 at the apex of the cone 29 and extends slantingly in a spiral to an outer end 34 at the periphery of the base 29. The driving surface 31 forms about two turns of a gradual spiral about the cone 29. To provide strength and to facilitate easy fabrication, the edge of the driving surface opposite to that outlining the cone is connected by solid strip or "shelf" 32 to the cone 29.

Although the direction of rotation of the dasher 13 of FIG. 1 or the dasher 28 of FIG. 5 is generally in that direction for moving the spiral vane 18 of FIG. 1 or the spiral driving surface 31 of FIG. 5 outwardly throughout the length thereof for thrusting wash outwardly, the dashers may be operated in the reverse direction to create a central, cyclonic current that is effective in cleaning. Particularly, the dasher 28 of FIGS. 4 and 5 that has the conical configuration is effective when operated in the reverse direction.

I claim:

1. A washing machine comprising:

a tub having a bottom and a substantially vertical wall for enclosing a space to contain wash, a dasher within said space, said dasher having a generally circular base and a hub about the axis of said base, unidirectional driving means connected to said hub to rotate said dasher about said axis thereof, a volute portion disposed on one side of said base, said volute portion being positioned within said space to permit freedom of movement of wash therein in any radial direction about said hub and in any direction incident to said one side of said base, said volute portion having a gradually curving smooth driving surface facing outwardly with respect to said hub, said driving surface having an inner end connected to said hub and extending spirally outwardly from said hub with gradually decreasing rate of curvature to an outer end of the driving surface terminating near the periphery of said base, and said ends of said driving surface having smooth and gradual contours.

2. A washing machine as claimed in claim 1 wherein said one side of said base is substantially conical, said inner end of said driving surface outlines the apex of said conical side about said hub, and said outer end terminates near the periphery of said base of said one side.

* * * * *